US006364193B1

(12) United States Patent
Tsai

(10) Patent No.: US 6,364,193 B1
(45) Date of Patent: Apr. 2, 2002

(54) ELECTRIC NAILING TOOL

(75) Inventor: Chen-Chieh Tsai, Taichung Hsien (TW)

(73) Assignee: Acumen Power Tools Corp., Taichung Hsien (TW)

( * ) Notice: Subject to any disclaimer, the term of this patent is extended or adjusted under 35 U.S.C. 154(b) by 0 days.

(21) Appl. No.: 09/867,051

(22) Filed: May 29, 2001

(51) Int. Cl.[7] ..... B25C 5/06; B25C 5/15

(52) U.S. Cl. ..... 227/131; 227/8; 310/14; 318/122

(58) Field of Search ..... 227/131, 8, 129, 227/133; 318/122; 310/14

(56) References Cited

U.S. PATENT DOCUMENTS 4,323,127 A * 4/1982 Cunningham ..... 227/131
4,349,143 A * 9/1982 Ewig ..... 227/131
4,573,621 A * 3/1986 Merkator et al. ..... 227/8
4,611,742 A * 9/1986 Rieker et al. ..... 227/131
4,946,087 A * 8/1990 Wingert ..... 227/131
5,760,552 A * 6/1998 Chen et al. ..... 318/122

* cited by examiner

*Primary Examiner*—Scott A. Smith
(74) *Attorney, Agent, or Firm*—Alan Kamrath; Rider, Bennett, Egan & Arundel, LLP

(57) ABSTRACT

An electric nailing tool comprises a housing, a nail magazine for supplying nails, a spout attached to the nail magazine and having a passage communicated with the housing, a solenoid set, and a hammer. The solenoid set comprises at least two solenoids having a common through-hole for receiving the hammer. A percussion member is securely attached to an end of the hammer to move therewith, thereby driving a nail in the passage out of the spout upon percussion movement of the hammer. The solenoids are energized and de-energized in sequence to move the hammer back and forth along the common through-hole of the solenoids, thereby providing at least two impacting motions by the percussion member to the nail in the passage.

6 Claims, 9 Drawing Sheets

ELECTRIC NAILING TOOL

BACKGROUND OF THE INVENTION

1. Field of the Invention

The present invention relates to an electric nailing tool and, more particularly, to an electric nailing tool, e.g., an electric nailing gun that provides at least two impacting motions to a relatively long nail to thereby assure complete nailing engagement of two objects by the relatively long nail.

2. Description of the Related Art

FIG. 6A of the drawings illustrates a conventional nailing tool that utilizes a single solenoid 3 for moving a hammer 1 rectilinearly. When the solenoid 3 is energized by means of turning an associated switch on, a magnetic force is generated to attract the hammer 1 to move. A percussion pin 4 attached to an end of the hammer 1 impacts on a nail 5 into two stacked objects 6 and 7 to be nailed together, as shown in FIG. 6B. When the switch for controlling the solenoid 3 is turned off, no current passes through the solenoid 3 and the hammer 1 returns to its initial position under the action of a spring 2 mounted around the other end of the hammer 1. Nevertheless, the hammer 1 must be longer than the solenoid 3 to maintain rectilinear downward movement of the hammer 1. This is because the magnetic field generated by the solenoid 3 incurs a force that acts in an opposite direction and thus compromises the impact force of the hammer 1 if the hammer 1 is too short. The volume and weight of the electric nailing tool are thus increased as a result of the long hammer 1. In addition, a relatively long nail cannot be completely hammered into the objects to be nailed together, as the electric nailing tool provides only one impacting motion. Furthermore, the solenoid generates heat and thus causes high temperature after operating a long time, which would lead damage to the control circuit for the electric nailing tool and sometimes might even burn the control circuit.

U.S. Pat. No. 5,760,552 to Chen et al. issued on Jun. 2, 1998 discloses a method of controlling driving power of double-solenoid electric percussion tools. Two solenoids are used to provide the maximum driving power and speed of the hammer. Nevertheless, the electric percussion tools disclosed in this patent cannot completely hammer a relatively long nail into the objects to be nailed together, as the electric nailing tool provides only one impacting motion.

SUMMARY OF THE INVENTION

It is the primary object of the present invention to provide an electric nailing tool that provides at least two impacting motions to a relatively long nail to thereby assure complete nailing engagement of two objects by the relatively long nail.

An electric nailing tool in accordance with the present invention comprises:

a housing;

a nail magazine for supplying nails;

a spout attached to the nail magazine and comprising a passage communicated with the housing, the nail magazine feeding nails to the passage;

a solenoid set comprising at least two solenoids having a common through-hole;

a hammer mounted in the common through-hole of said at least two solenoids, the hammer including an end, a percussion member being securely attached to the end of the hammer to move therewith, the percussion member extending through the passage of the spout for driving a nail in the passage out of the spout upon percussion movement of the hammer in a direction, the hammer being biased to move in another direction opposite to the direction when none of said at least two solenoids is energized;

wherein said at least two solenoids are energized and de-energized in sequence to move the hammer back and forth along the common through-hole of said at least of solenoids, thereby providing at least two impacting motions by the percussion member to the nail in the passage.

In a first embodiment of the invention, an electric nailing tool comprises:

a housing;

a nail magazine for supplying nails;

a spout attached to the nail magazine and comprising a passage communicated with the housing, the nail magazine feeding nails to the passage;

a solenoid set comprising a first solenoid and a second solenoid that have a common through-hole;

a hammer mounted in the common through-hole, the hammer including an end, a percussion member being securely attached to the end of the hammer to move therewith, the percussion member extending through the passage of the spout for driving a nail in the passage out of the spout upon percussion movement of the hammer in a first direction, the hammer being biased by an elastic element to move in a second direction opposite to the first direction when none of the solenoids is energized;

wherein the end of the first solenoid rests at an initial position in the first solenoid when non of the solenoids is energized;

wherein when the first solenoid is energized, the hammer is moved in the first direction, and the first solenoid is de-energized when the end of the hammer reaches a first position in the second solenoid and the hammer moves in the second direction under action of the elastic element;

wherein the second solenoid is energized when the end of the hammer reaches a second position that is between the initial position and the first position, thereby moving the hammer in the first direction again until the end of the hammer reaches a position farther than the first position.

In a second embodiment of the invention, an electric nailing tool comprises:

a housing;

a nail magazine for supplying nails;

a spout attached to the nail magazine and comprising a passage communicated with the housing, the magazine feeding nails to the passage;

a solenoid set comprising a first solenoid, a second solenoid, and a third solenoid that have a common through-hole;

a hammer mounted in the common through-hole, the hammer including an end, a percussion member being securely attached to the end of the hammer to move therewith, the percussion member extending through the passage of the spout for driving a nail in the passage out of the spout upon percussion movement of the hammer in a first direction, the hammer being biased by an elastic element to move in a second direction opposite to the first direction when none of the three solenoids is energized;

wherein the end of the first solenoid rests at an initial position in the first solenoid when non of the solenoids is energized;

wherein when the first solenoid is energized, the hammer is moved in the first direction, and the first solenoid is de-energized when the end of the hammer reaches a first position outside the first solenoid and the hammer moves in the second direction under action of the elastic element;

wherein the second solenoid is energized when the end of the hammer reaches a second position that is between the initial position and the first position, thereby moving the hammer in the first direction again, the second solenoid is de-energized when the end of the hammer reaches a third position farther than the first position and the hammer moves in the second direction under action of the elastic element;

wherein the third solenoid is energized when the end of the hammer reaches a fourth position between the second position and the third position, thereby moving the hammer in the first direction again until the end of the hammer reaches a position farther than the first position.

The spout further comprises an actuating rod. The electric nailing tool further comprises a trigger and a safety switch that is mounted in the housing. The trigger is inoperative when the actuating rod is not pressed against an object to be nailed. Trigger is operative when the actuating rod is pressed against the object to be nailed and thus impinges the safety switch.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
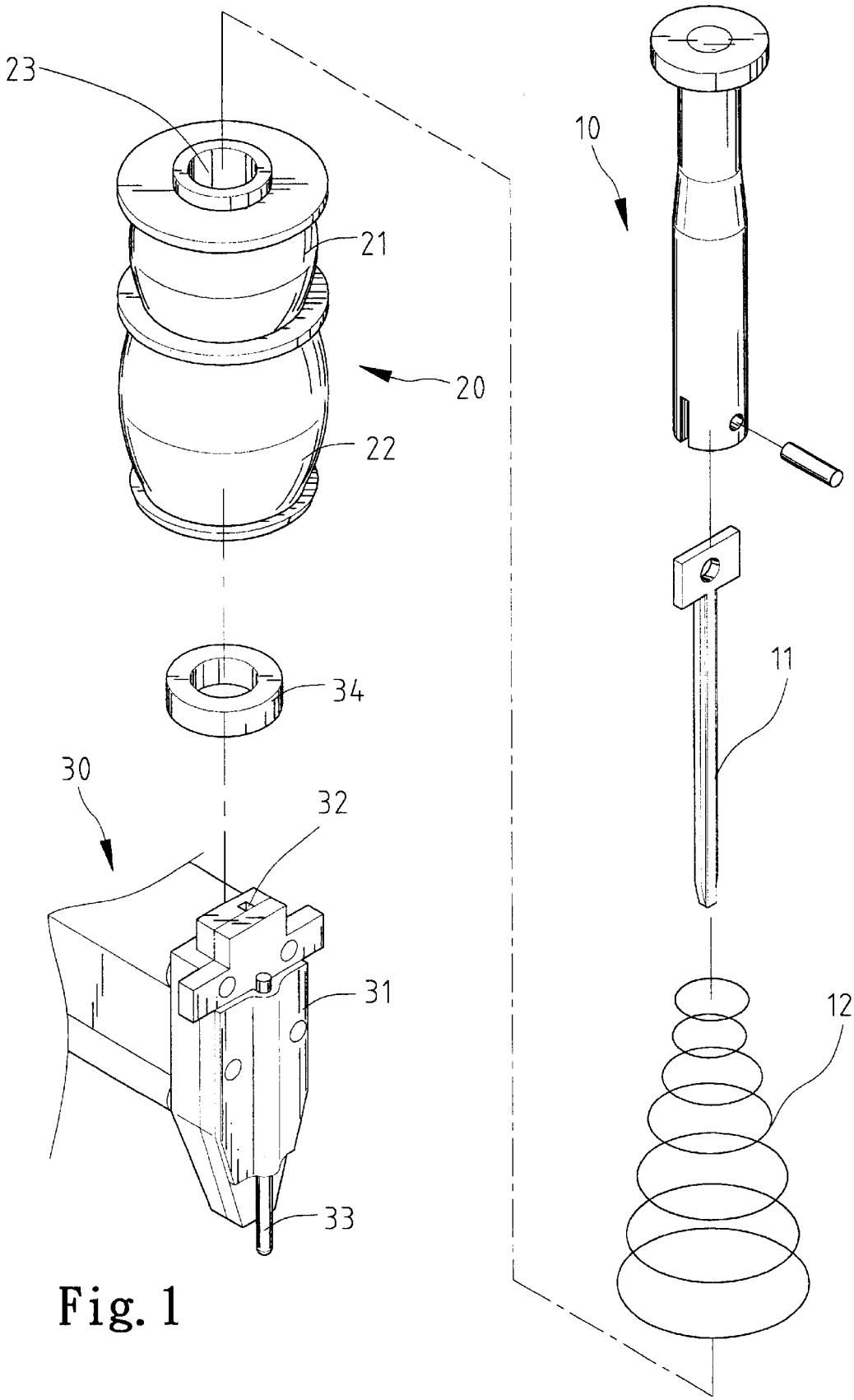
FIG. 1 is an exploded perspective view of a portion of an electric nailing tool in accordance with the present invention.
Figure 2:
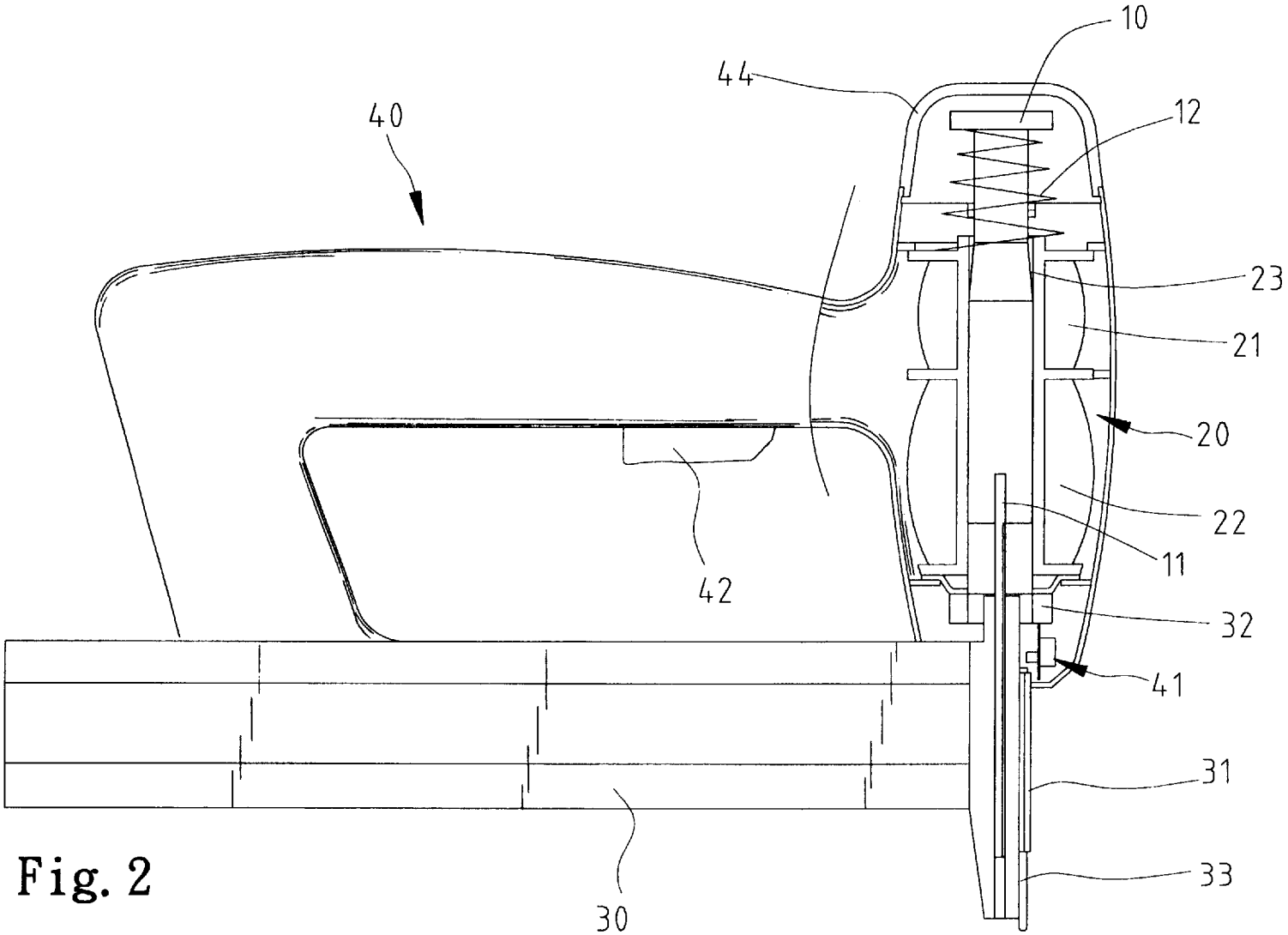
FIG. 2 is a sectional view of the electric nailing tool in FIG. 1.

Referring to FIGS. 1 and 2, an electric nailing tool (e.g., an electric nailing gun) 40 in accordance with the present invention generally comprises a housing 44 for receiving a hammer 10 having a percussion member (e.g., a percussion pin) 11 securely attached to an end thereof. An elastic element 12 is mounted around the other end of the hammer 10. The electric nailing tool further comprises a solenoid set 20 mounted in the housing 44 and comprised of a first solenoid 21 and a second solenoid 22 that are preferably integrally formed with each other with a through-hole 23 extending through the two solenoids 21 and 22.

Referring to FIG. 2, the electric nailing tool 40 further comprises a nail magazine 30 below the housing 44 and a spout 31 fixed to an end of the nail magazine 40. The spout 31 has a passage 32 that is communicated with the housing 44 and allows dispensation of nails. The nail magazine 30 feeds nails to the passage 32. An actuating rod 33 is attached to a side of the spout 31. As illustrated in FIG. 2, the hammer 10 and the solenoid set 20 are housed in the housing 44 of the electric nailing tool with a portion of the hammer 10 extending through the through-hole 23 of the solenoid set 20 and with the percussion pin 11 extending through the passage 32 of the spout 31.

Still referring to FIG. 2, when the actuating rod 33 is not born against an object, a safety switch 41 in the housing 44 of the electric nailing tool is not impinged such that the electric nailing tool cannot work even if a trigger 42 of the electric nailing tool is triggered.

Figure 3:
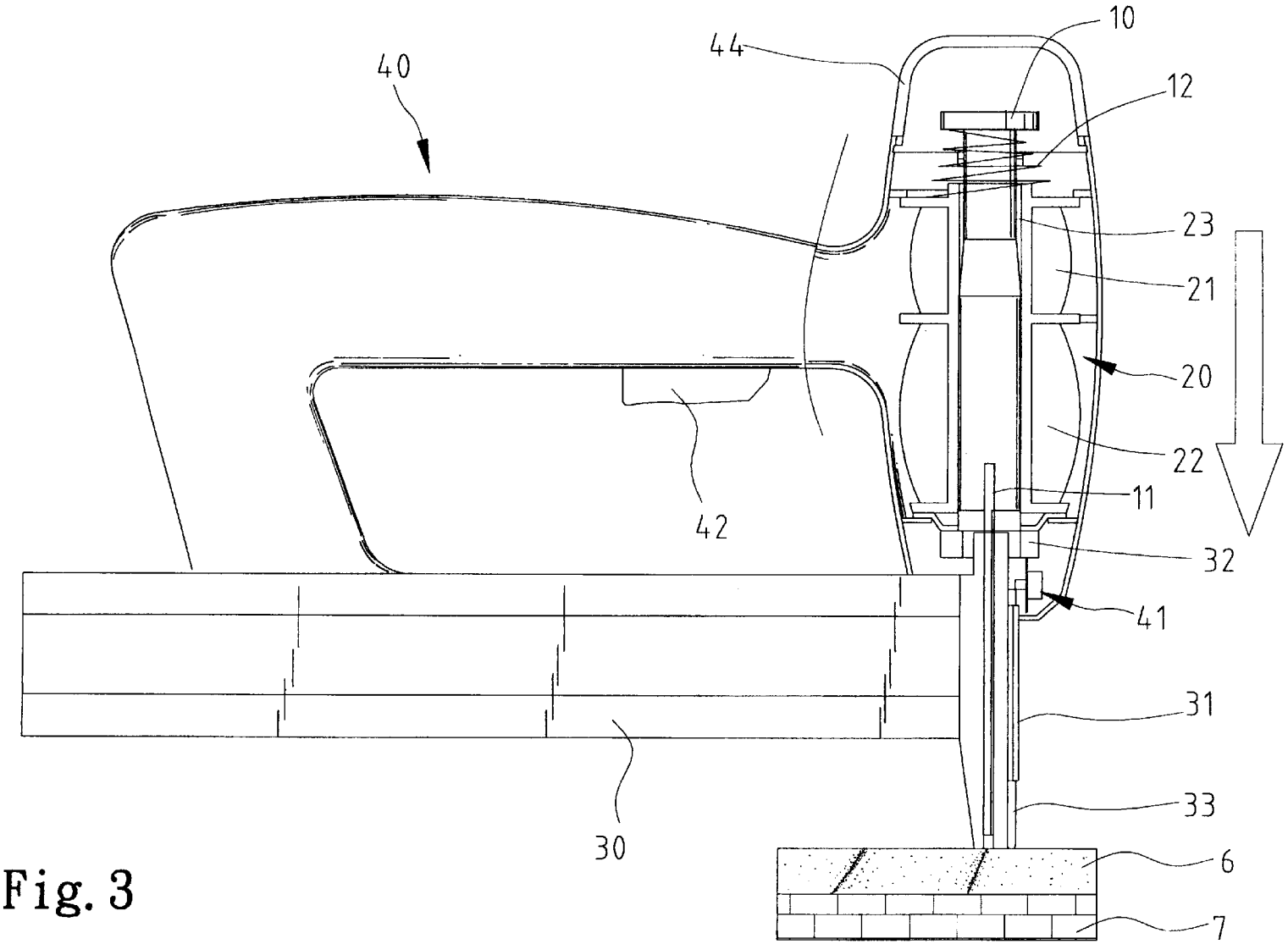
FIG. 3 is a sectional view similar to FIG. 2, illustrating operation of the electric nailing tool in accordance with the present invention.

Referring to FIG. 3, when nailing is required, the user presses the spout 31 against an object 6 such that an end of the actuating rod 33 is pressed. Thus, the actuating rod 33 is moved to impinge the safety switch 42, and a nail is dispensed via the spout 30 to nail two stacked objects 6 and 7 together when the user triggers.

Figure 4B:
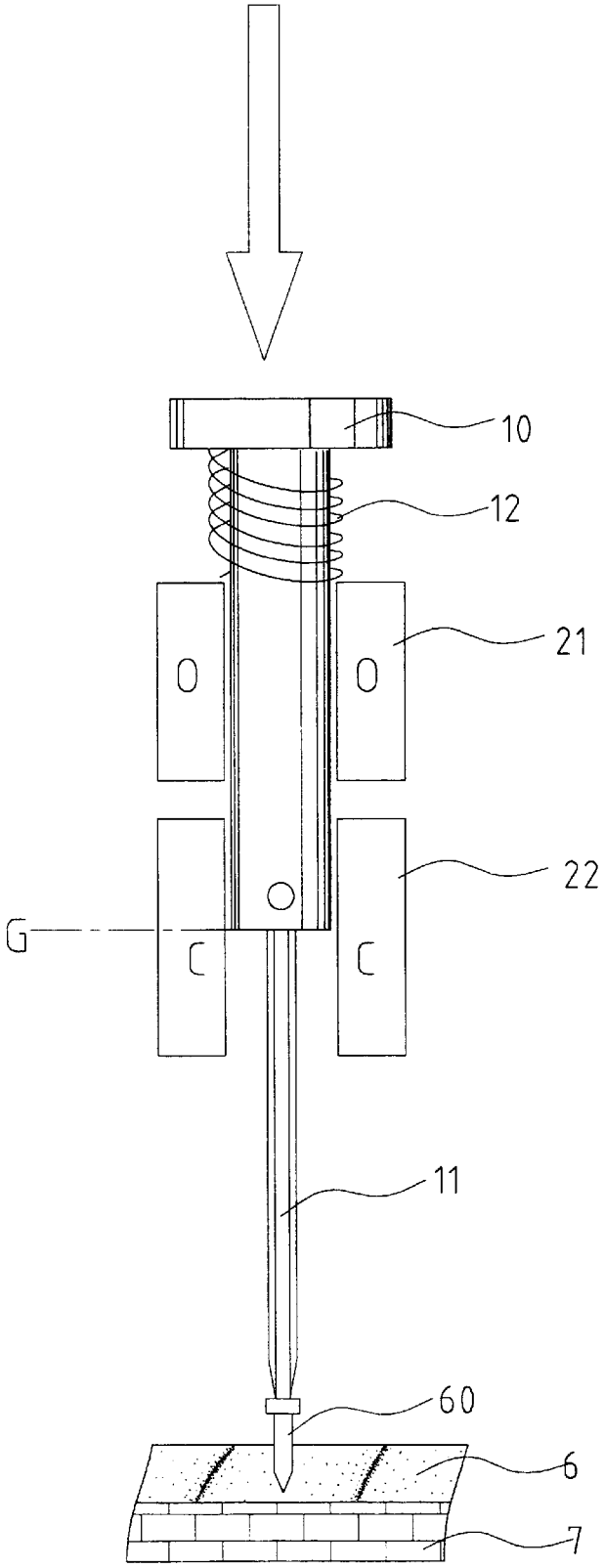
FIG. 4B is a schematic view similar to FIG. 4A, illustrating a first impacting movement of the hammer.
Figure 4A:
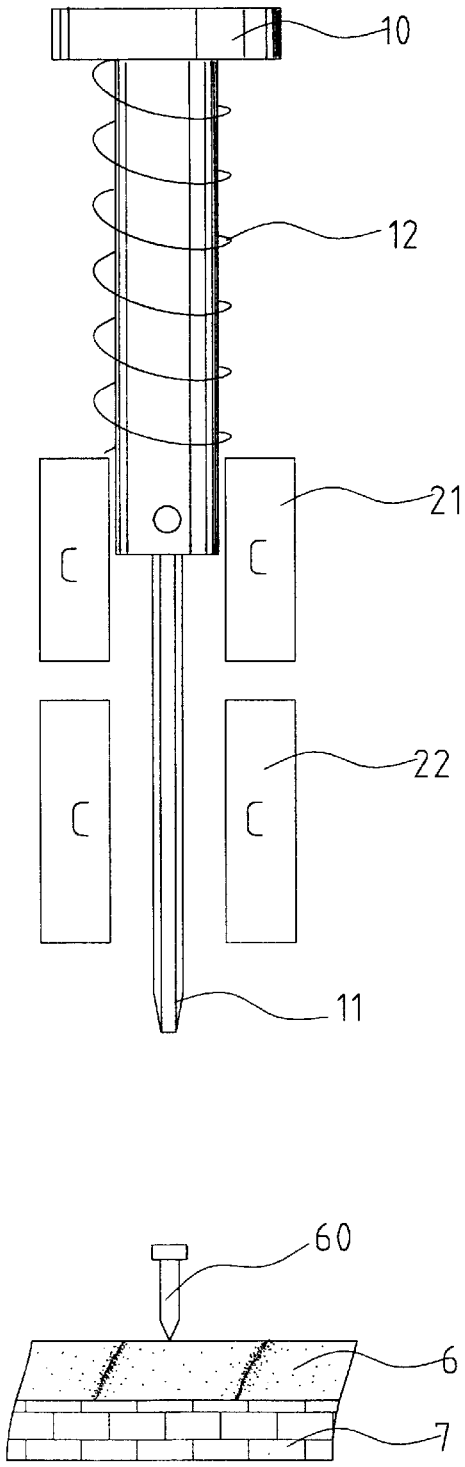
FIG. 4A is a schematic view of a hammer and a solenoid set for controlling movement of the hammer.

The solenoid set 20 in FIG. 4A is not energized and the lower end of the hammer 10 is initially located in the first solenoid 21. When a switch for controlling the first solenoid 21 is tuned on, as illustrated in FIG. 4B, the first solenoid 21 is energized and thus generates a downward magnetic force to move the hammer 10 downward until a lower end of the hammer 10 reaches a point G, which can be an arbitrary point in the second solenoid 22. The percussion pin 11 impacts a nail 60 into an upper one of two objects 6 and 7 to be nailed together.

Figure 4D:
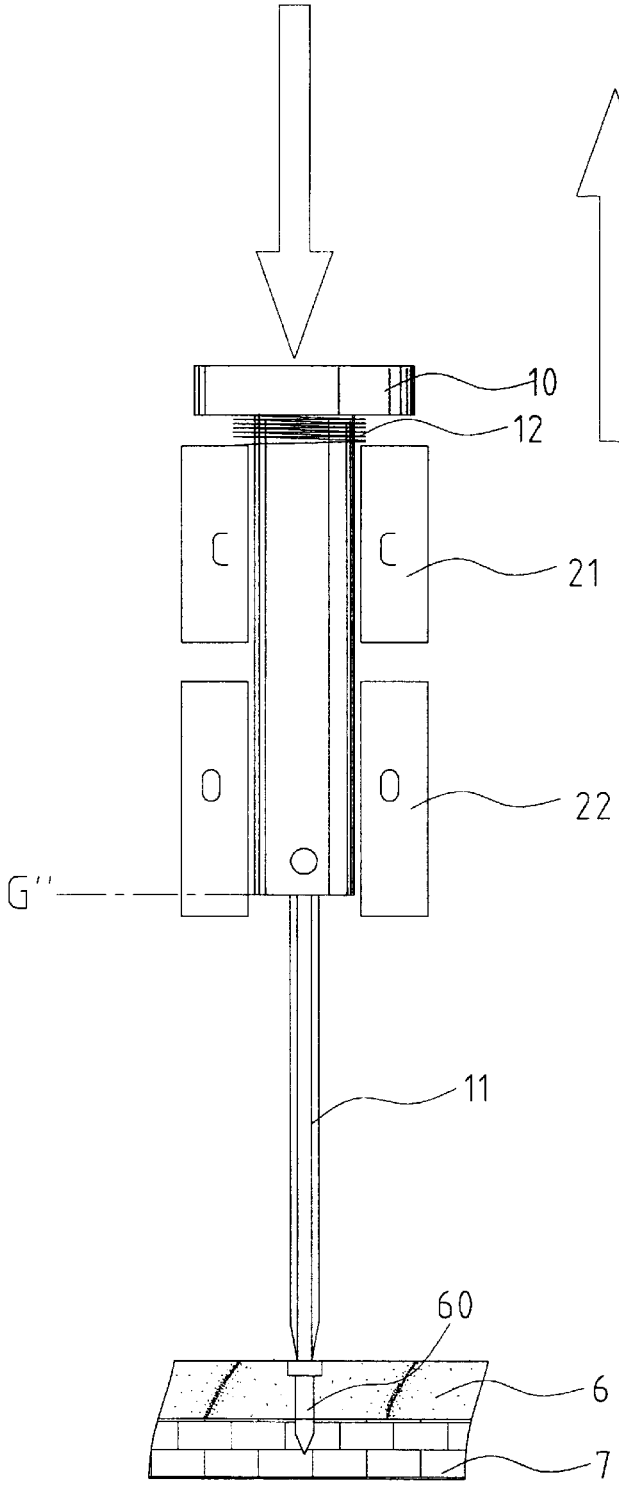
FIG. 4D is a schematic view similar to FIG. 4A, illustrating a second impacting movement of the hammer.
Figure 4C:
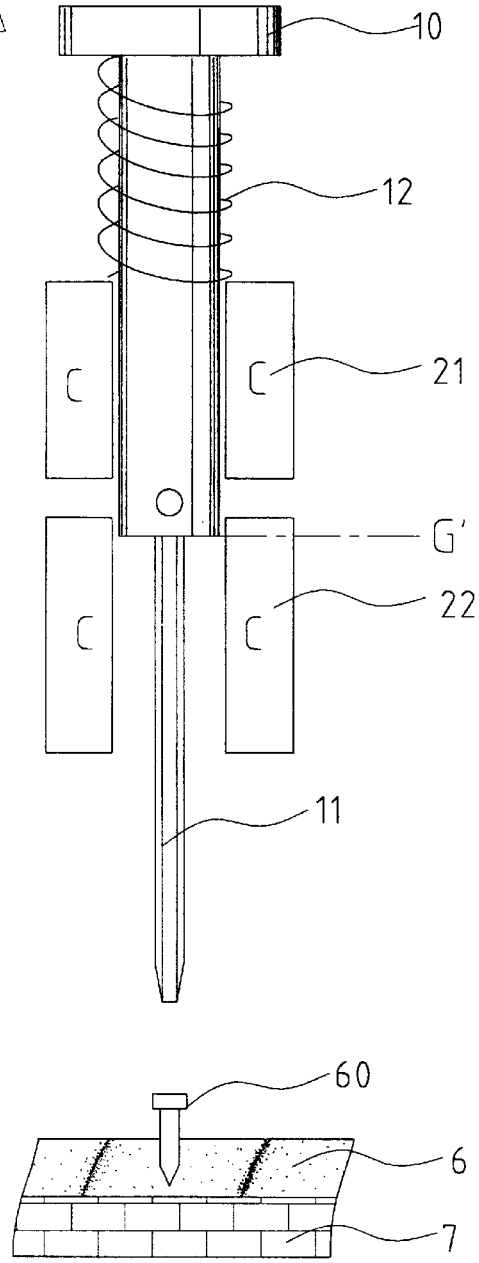
FIG. 4C is a schematic view similar to FIG. 4A, illustrating a returning motion of the hammer.

Referring to FIG. 4C, the switch for controlling the first solenoid 21 is then turned off such that the magnetic force vanishes, and the hammer 10 is moved upward under the returning action of the elastic element 12. The second solenoid 22 is energized when the lower end of the hammer 10 reaches a point G' that is between point G and the initial position of the lower end of the hammer 10. A magnetic force is thus generated by means of conduction of the second solenoid 22 to move the hammer 10 downward again. Thus, the lower end of the hammer 10 moves to a position G" farther than the pint G, as illustrated in FIG. 4D. The nail 60 is impacted again and thus penetrates through the upper object 6 into the lower object 7, thereby nailing the objects 6 and 7 together. It is noted that there are many control circuits can be used to achieve controlling of the energizing of the solenoids 21 and 22 without departing from the scope of the invention, and the invention is not limited to any one of the control circuits.

Figure 5B:
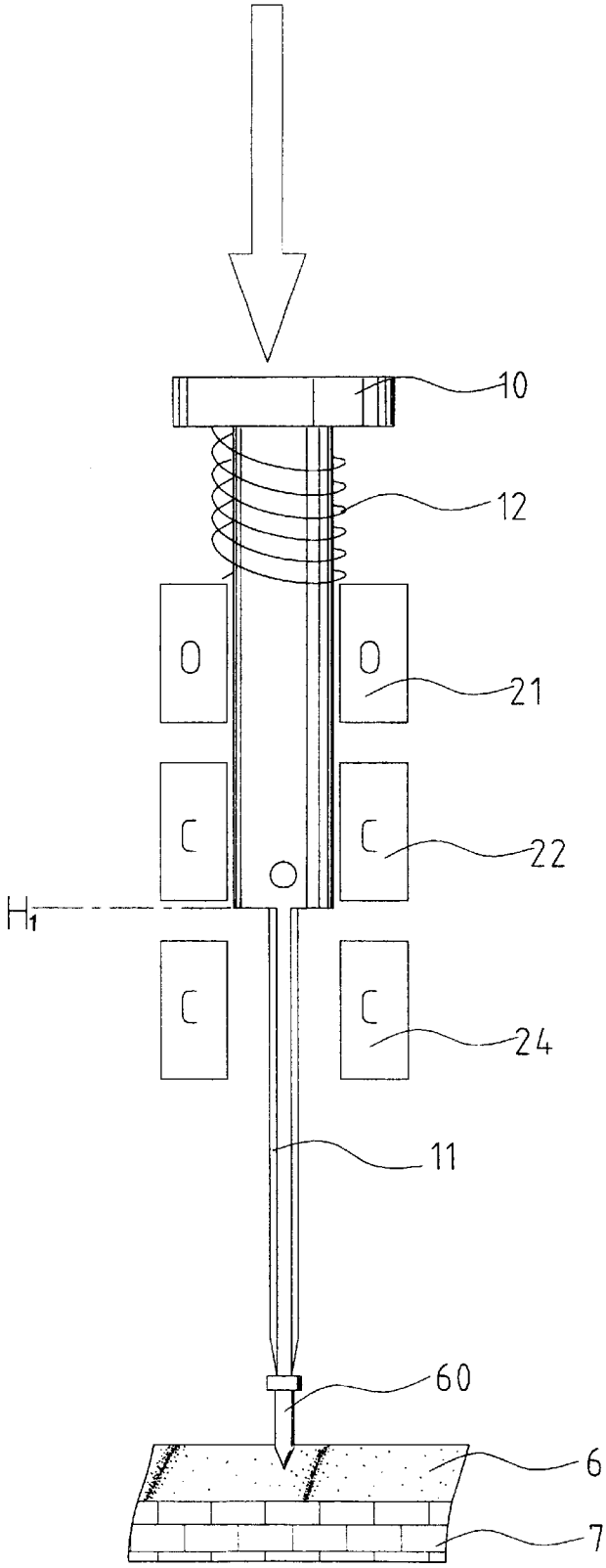
FIG. 5B is a schematic view similar to FIG. 5A, illustrating a first impacting movement of the hammer.
Figure 5A:
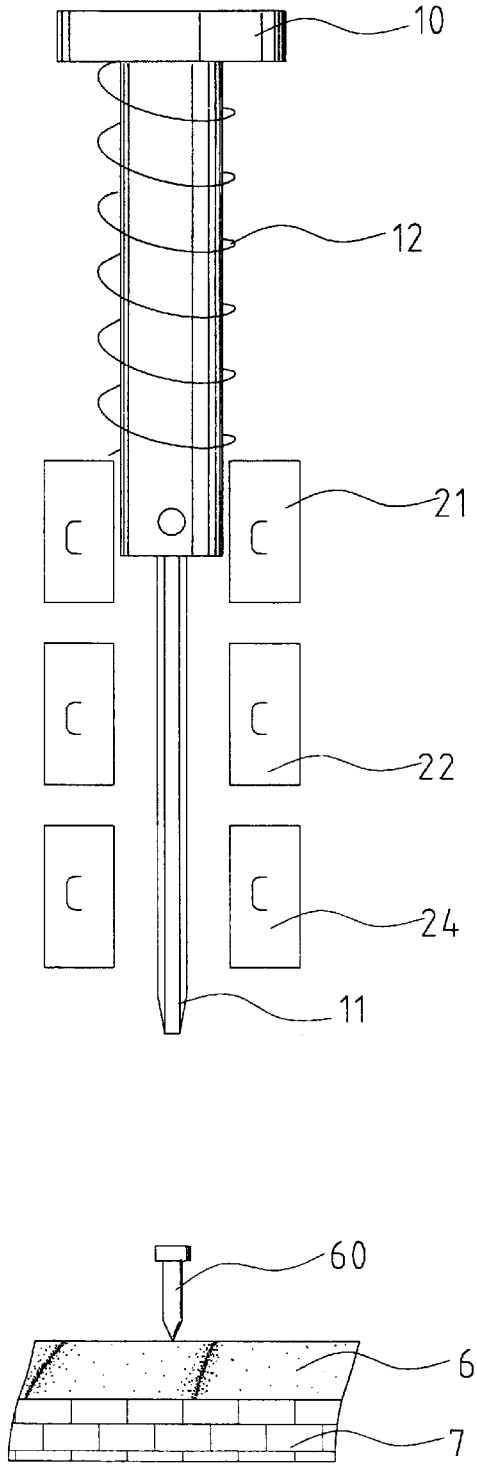
FIG. 5A is a schematic view of a hammer and a modified solenoid set for controlling movement of the hammer.
Figure 5D:
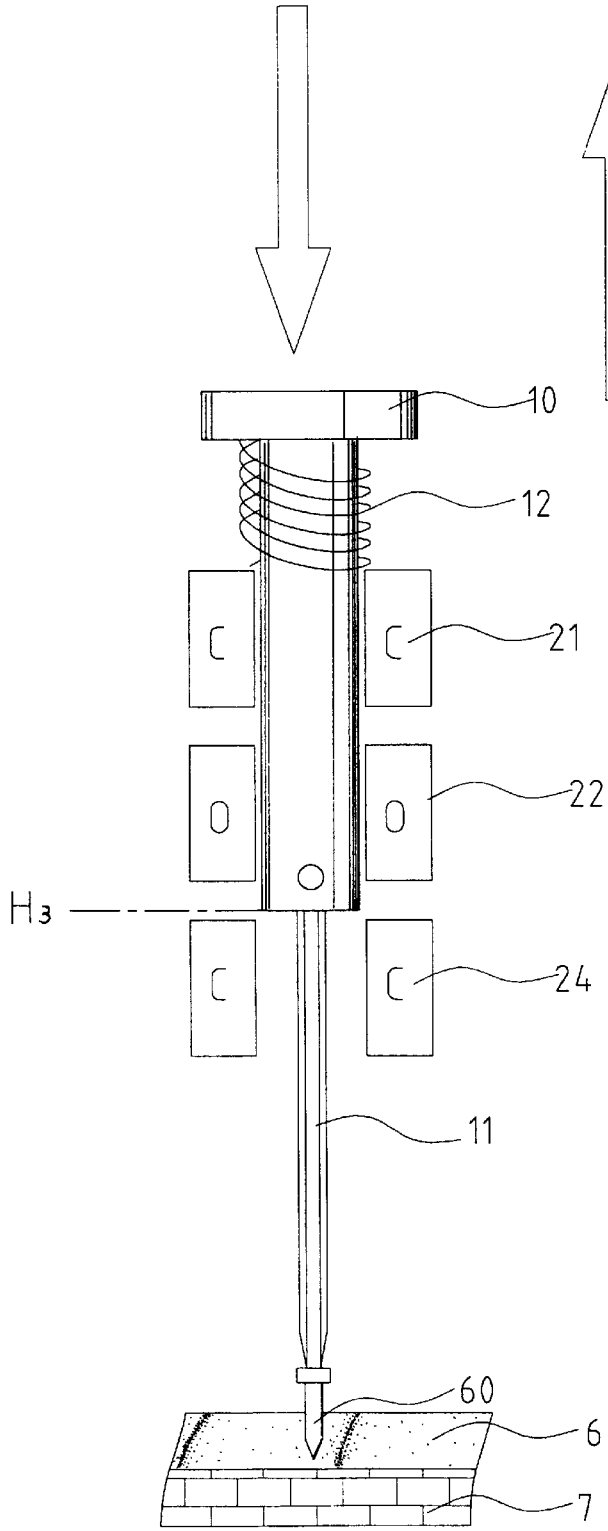
FIG. 5D is a schematic view similar to FIG. 5A, illustrating a second impacting movement of the manner.

FIG. 5A illustrates a modified embodiment of the solenoid set. In this embodiment, the solenoid set comprises a first solenoid 21, a second solenoid 22, and a third solenoid 24 that are connected in series. Preferably the solenoids 21, 22, and 24 are integrally formed with one another with a through-hole extending through the three solenoids 21, 22, and 24.

The solenoid set in FIG. 5A is not energized and the lower end of the hammer 10 is initially located in the first solenoid. When a switch for controlling the first solenoid 21 is tuned on, as illustrated in FIG. 5B, the first solenoid 21 is energized and thus generates a downward magnetic force to move the hammer 10 downward until a lower end of the hammer 10 reaches a point $H_1$ between the second solenoid 22 and the third solenoid 24. The percussion member 11 impacts a nail 60 into an upper one of two stacked objects 6 and 7 to be nailed together.

Figure 5C:
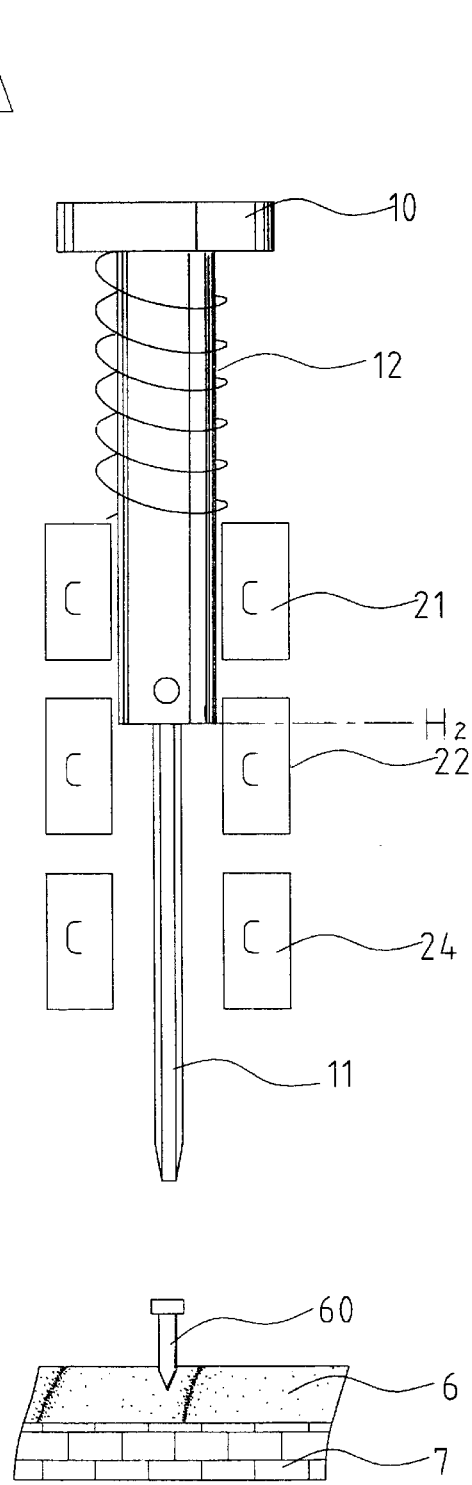
FIG. 5C is a schematic view similar to FIG. 5A, illustrating a first returning motion of the hammer.

Referring to FIG. 5C, the switch for controlling the first solenoid 21 is then turned off such that the magnetic force vanishes, and the hammer 10 is moved upward under the returning action of the elastic element 12. The second solenoid 22 is energized when the lower end of the hammer 10 reaches a point $H_2$ between the point $H_1$ and the initial position. A magnetic force is thus generated by means of conduction of the second solenoid 22 to move the hammer 10 downward again until the lower end of the hammer 10 reaches a position $H_3$ that is farther than the point $H_1$. The nail 60 is impacted again and thus penetrates into the upper object 6 to a deeper position.

Figure 5F:
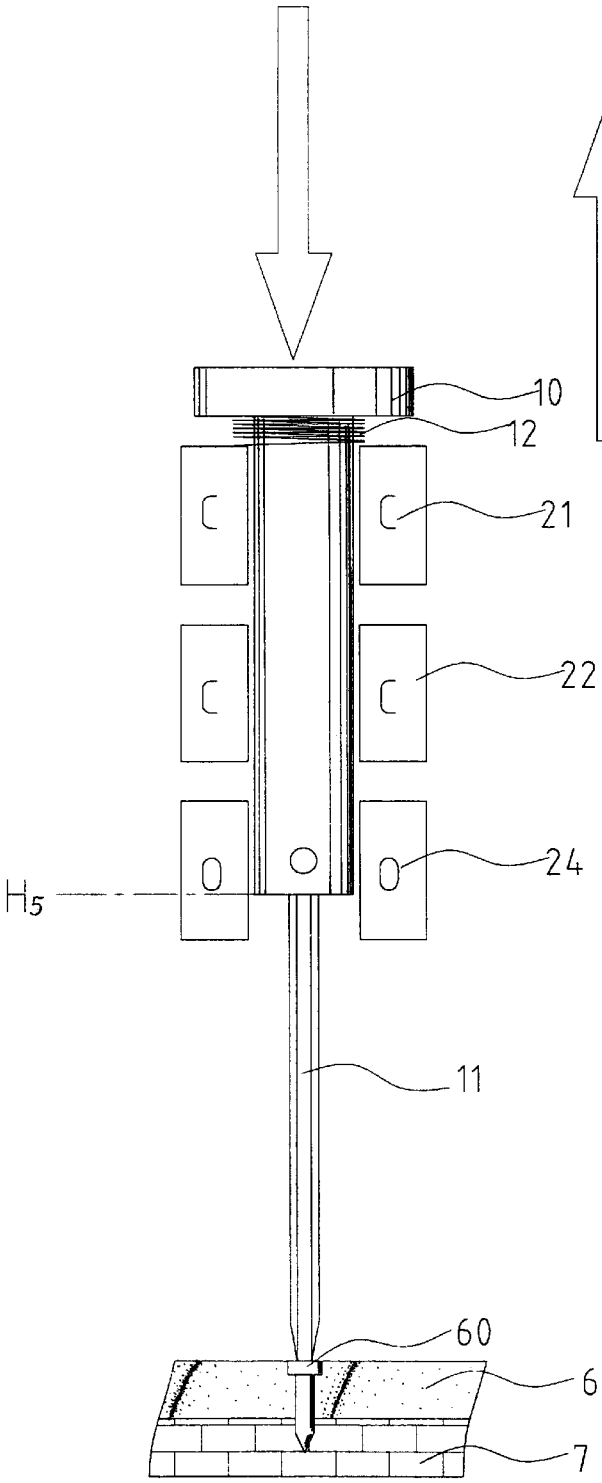
FIG. 5F is a schematic view similar to FIG. 5A, illustrating a third impacting movement of the hammer.
Figure 5E:
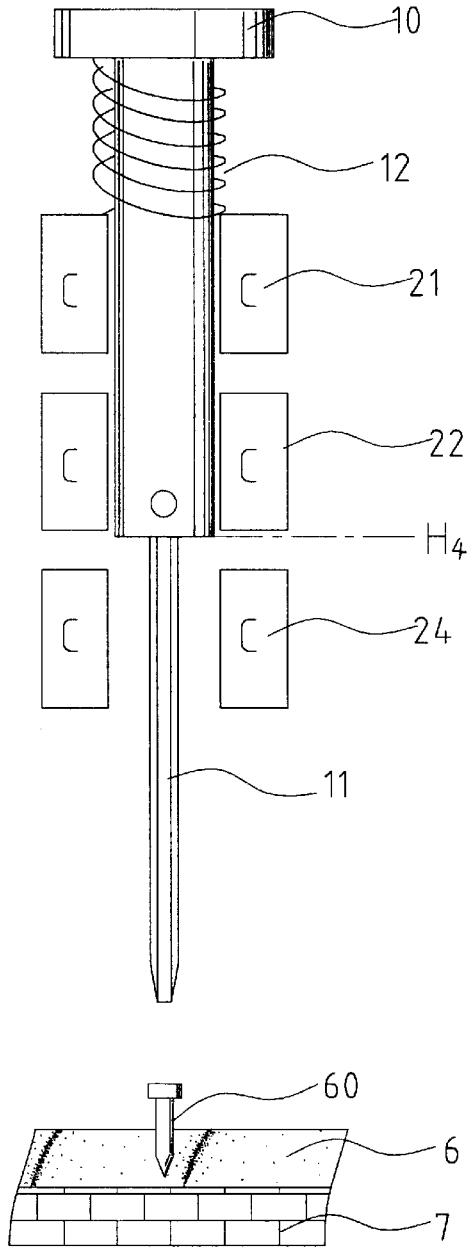
FIG. 5E is a schematic view similar to FIG. 5A, illustrating a second returning motion of the hammer.
Figure 6B:
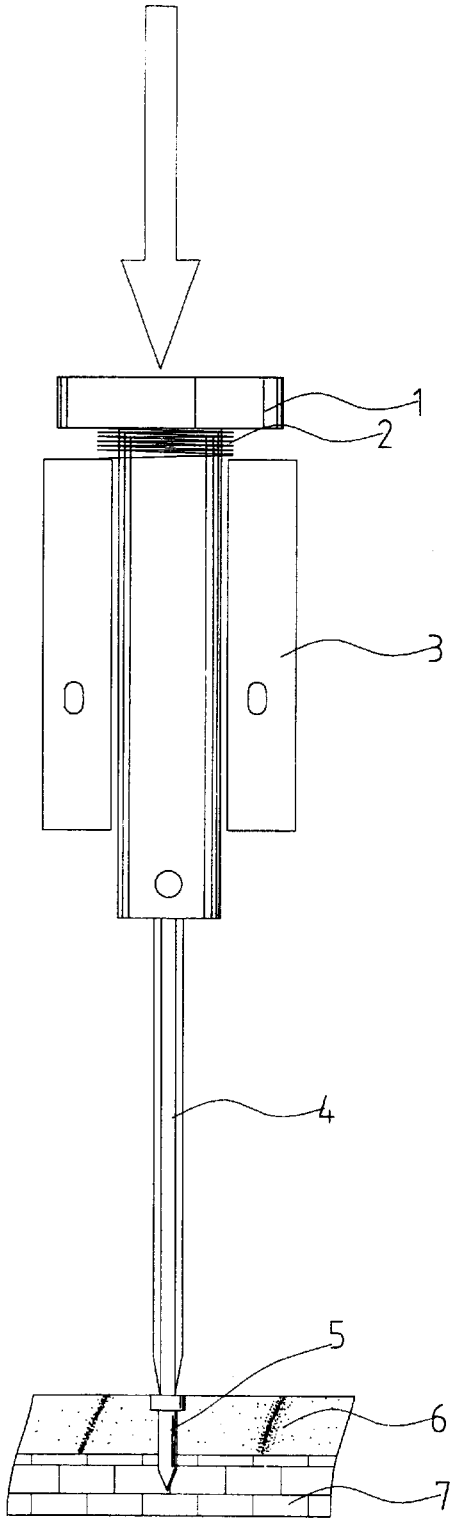
FIG. 6B is a view similar to FIG. 6A, illustrating operation of the conventional electric nailing tool
Figure 6A:
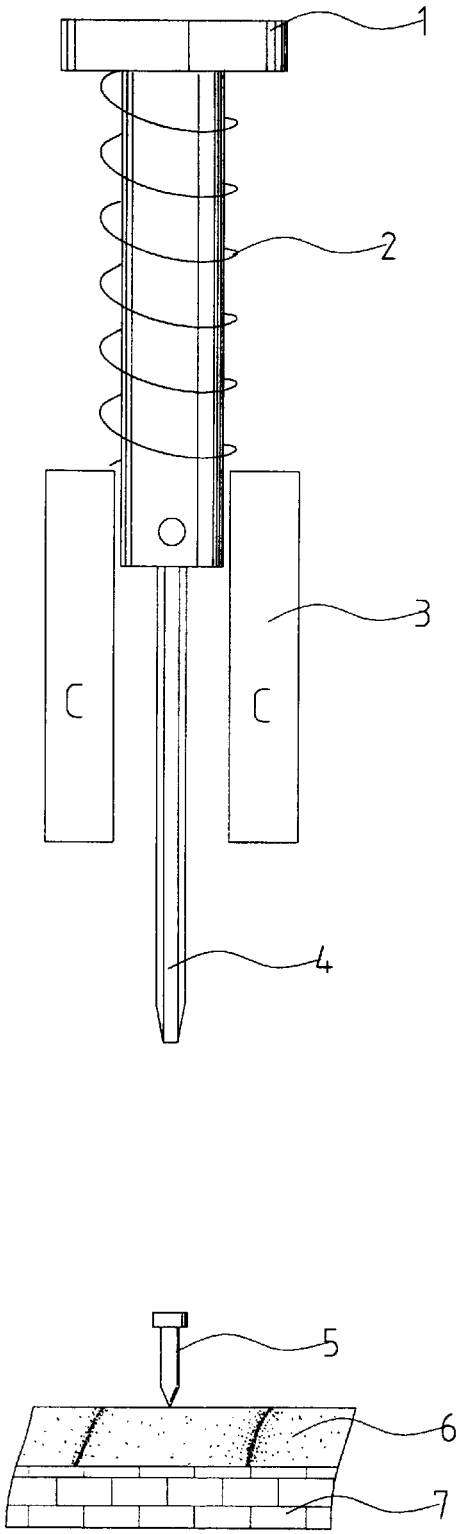
Fig. 6A PRIOR ART
FIG. 6A is a schematic view of a conventional electric nailing tool.

Referring to FIG. 5E, the switch for controlling the second solenoid 22 is then turned off such that the magnetic force vanishes, and the hammer 10 is moved upward again under the returning action of the elastic element 12. The third solenoid 24 is energized when the lower end of the hammer 10 reaches a point $H_4$ between the point $H_2$ and the point $H_3$. A magnetic force is thus generated by means of conduction of the third solenoid 24 to move the hammer 10 downward again until the lower end of the hammer 10 reaches a position $H_5$ that is farther than the point $H_3$, as illustrated in FIG. 5F. The nail 60 is impacted again and thus penetrates through the upper object 6 into the lower object 7, thereby nailing the objects 6 and 7 together.

According to the above description, it is appreciated that the hammer of the electric nailing tool in accordance with the present invention provides at least two impacting motions to effectively hammer a relatively long nail for nailing two objects together. It is not necessary to have the hammer longer than the solenoids for the purpose of maintaining a rectilinear downward movement of the hammer. In addition, the best nailing effect can be obtained without increasing the volume and weight of the electric nailing tool. Further, high temperature of the control circuit of the electric nailing tool is avoided under alternate use of the solenoids.

Although the invention has been explained in relation to its preferred embodiment, it is to be understood that many other possible modifications and variations can be made without departing from the scope of the invention as hereinafter claimed.

What is claimed is:

1. An electric nailing tool comprising:

a housing;

a nail magazine for supplying nails;

a spout attached to the nail magazine and comprising a passage communicated with the housing, the nail magazine feeding nails to the passage;

a solenoid set comprising at least two solenoids having a common through-hole;

a hammer mounted in the common through-hole of said at least two solenoids, the hammer including an end, a percussion member being securely attached to the end of the hammer to move therewith, the percussion member extending through the passage of the spout for driving a nail in the passage out of the spout upon percussion movement of the hammer in a direction, the hammer being biased to move in another direction opposite to the direction when none of said at least two solenoids is energized;

wherein said at least two solenoids are energized and de-energized in sequence to move the hammer back and forth along the common through-hole of said at least of solenoids, thereby providing at least two impacting motions by the percussion member to the nail in the passage.

2. The electric nailing tool as claimed in claim 1, wherein the spout further comprises an actuating rod, the electric nailing tool further comprising a trigger and a safety switch that is mounted in the housing, wherein the trigger is inoperative when the actuating rod is not pressed against an object to be nailed, and wherein the trigger is operative when the actuating rod is pressed against the object to be nailed and thus impinges the safety switch.

3. An electric nailing tool comprising:

a housing;

a nail magazine for supplying nails;

a spout attached to the nail magazine and comprising a passage communicated with the housing, the nail magazine feeding nails to the passage;

a solenoid set comprising a first solenoid and a second solenoid that have a common through-hole;

a hammer mounted in the common through-hole, the hammer including an end, a percussion member being securely attached to the end of the hammer to move therewith, the percussion member extending through the passage of the spout for driving a nail in the passage out of the spout upon percussion movement of the hammer in a first direction, the hammer being biased by an elastic element to move in a second direction opposite to the first direction when none of the solenoids is energized;

wherein the end of the first solenoid rests at an initial position in the first solenoid when none of the solenoids is energized;

wherein when the first solenoid is energized, the hammer is moved in the first direction, and the first solenoid is de-energized when the end of the hammer reaches a first position in the second solenoid and the hammer moves in the second direction under action of the elastic element;

wherein the second solenoid is energized when the end of the hammer reaches a second position that is between the initial position and the first position, thereby moving the hammer in the first direction again until the end of the hammer reaches a position farther than the first position.

4. The electric nailing tool as claimed in claim 3, wherein the spout further comprises an actuating rod, the electric nailing tool further comprising a trigger and a safety switch that is mounted in the housing, wherein the trigger is inoperative when the actuating rod is not pressed against an object to be nailed, and wherein the trigger is operative when the actuating rod is pressed against the object to be nailed and thus impinges the safety switch.

5. An electric nailing tool comprising:

a housing;

a nail magazine for supplying nails;

a spout attached to the nail magazine and comprising a passage communicated with the housing, the magazine feeding nails to the passage;

a solenoid set comprising a first solenoid, a second solenoid, and a third solenoid that have a common through-hole;

a hammer mounted in the common through-hole, the hammer including an end, a percussion member being securely attached to the end of the hammer to move therewith, the percussion member extending through the passage of the spout for driving a nail in the passage out of the spout upon percussion movement of the hammer in a first direction, the hammer being biased by an elastic element to move in a second direction opposite to the first direction when none of the three solenoids is energized;

wherein the end of the first solenoid rests at an initial position in the first solenoid when none of the solenoids is energized;

wherein when the first solenoid is energized, the hammer is moved in the first direction, and the first solenoid is de-energized when the end of the hammer reaches a first position outside the first solenoid and the hammer moves in the second direction under action of the elastic element;

wherein the second solenoid is energized when the end of the hammer reaches a second position that is between the initial position and the first position, thereby moving the hammer in the first direction again, the second solenoid is de-energized when the end of the hammer reaches a third position farther than the first position and the hammer moves in the second direction under action of the elastic element;

wherein the third solenoid is energized when the end of the hammer reaches a fourth position between the second position and the third position, thereby moving the hammer in the first direction again until the end of the hammer reaches a position farther than the first position.

6. The electric nailing tool as claimed in claim 5, wherein the spout further comprises an actuating rod, the electric nailing tool further comprising a trigger and a safety switch that is mounted in the housing, wherein the trigger is inoperative when the actuating rod is not pressed against an object to be nailed, and wherein the trigger is operative when the actuating rod is pressed against the object to be nailed and thus impinges the safety switch.

* * * * *